United States Patent [19]

Greenawalt

[11] Patent Number: 4,803,743

[45] Date of Patent: Feb. 14, 1989

[54] PILLOW

[76] Inventor: Kent S. Greenawalt, 1100 Mela Dr., Dubuque, Iowa 52001

[21] Appl. No.: 745,609

[22] Filed: Jun. 17, 1985

[51] Int. Cl.[4] ..... A47G 9/00

[52] U.S. Cl. ..... 5/434; 5/436

[58] Field of Search ..... 5/434, 436, 442, 464, 5/431, 437, 441

[56] References Cited

U.S. PATENT DOCUMENTS

| | | | |
|---|---|---|---|
| 1,020,444 | 3/1912 | Platt . | |
| 2,880,428 | 4/1959 | Forsland . | |
| 2,940,088 | 6/1960 | Boos | 5/436 |
| 3,521,310 | 7/1970 | Greenawalt . | |
| 3,648,308 | 3/1972 | Greenawalt | 297/391 |
| 4,424,599 | 1/1984 | Hannouche | 5/436 |
| 4,494,261 | 1/1985 | Morrow | 5/436 |

FOREIGN PATENT DOCUMENTS

| | | | |
|---|---|---|---|
| 0059881 | 9/1982 | European Pat. Off. | 5/442 |
| 2701557 | 7/1978 | Fed. Rep. of Germany | 5/434 |

OTHER PUBLICATIONS

Exhibit AX—Photographs of an 1979 Pillow Mad of Record by Protestor in Paper No. 7½.

Letter, Greenawalt to Walpin with Set of Sample Pillow Dimensions Suggested by Walpin.

Correspondence between Dr. Walpin and Mr. K. Greenawalt.

Trial Transcript; Walpin Testimony, Dec. 6, 1985, pp. 7–13.

Photograph of Pillow.

Transcript of Proceedings, Friday, Dec. 13, 1985.

Pillo-Pedic Brochure.

Letter, Greenawalt to Walpin, dated Jun. 16, 1978.

Collection of Correspondence, Apr. 9, 1985 to Jun. 17, 1985.

Letter, Corell to Walpin, dated Aug. 6, 1986.

Pillo-Pedic, Jr. Advertisement.

Distributorship Agreement, Sep. 17, 1977.

*Primary Examiner*—Alexander Grosz

*Attorney, Agent, or Firm*—Henderson & Sturm

[57] ABSTRACT

The invention comprises a therapeutic pillow (10) for supporting the head and neck of a person lying in a supine position. The pillow (10) comprises a pair of pillow members (11) and (12) combined to form a single pillow. Pillow member (11) has upper opposite sides (16) and (21) joined to the upper portions of opposed edges (17) and (19), one of which is higher or thicker than the other, a planar surface (18) joining the lower portions of the edges (17) and (19), and a normally non-exposed irregular surface (23–28) extended between the sides (16) and (21). The second pillow (12) has one side (32–37) that mates with the irregular surface of the first pillow member (11) and an opposite side (31) which is relatively smooth. The density of the two pillow members varies, member (11) being more dense than member (12).

1 Claim, 2 Drawing Sheets

PILLOW

TECHNICAL FIELDS

This invention relates generally to pillows, and more particularly to a combination head and neck pillow designed to be placed under the head and neck of a person lying in a supine position.

BACKGROUND ART

This invention relates to pillow construction, and more particularly to pillows which aid in relieving stress in the cervical or neck portion of the upper spine, and for promoting proper posture. Since approximately one-third of all human existence is spent in a supine position, innovators in posture or cervical pillows have long continued to develop new designs of this type of pillow which will support the head and spine, and the neck vertabrae in particular in the most normal, comfortable and unstressed position.

Prior art efforts at achieving such a pillow have shown the use of a combination of firm and soft portions of a pillow in varied arrangements, but which have either resulted in a flattening of the spinal column, or in exaggerating the curvature thereof. Furthermore, such prior art efforts do not provide the variety of therapeutic uses of the same pillow for different age and frame groups.

SUMMARY OF THE INVENTION

This invention provides a therapeutic pillow the construction of which enables it to be used over a period of years by youngsters and small framed adults for the treatment of conditions such as: improper cervical spine alignment, whiplash, cervical strains and sprains, tension headaches, and neck or shoulder problems.

The pillow of this invention provides effectively four different support positions for the head, neck and shoulders of a person, whether lying supine or on the side. A first position provides a wide or high firm edge of the pillow with a soft center. A second position provides a narrow or low firm edge with a soft center. Upon reversing or flipping the pillow over, a third position provides a wide or high firm edge with a medium center; and a fourth position of the pillow provides a narrow or low firm edge with a medium center.

These positions are provided by a pair of pillows bonded together to form one. The first pillow member has one side or edge higher or thicker than the other; with the bottom surface for example, planar and with an irregular depression formed in the upper or opposite surface. The second pillow member is of a different resistance to depression, being somewhat softer than the first pillow member, and is adapted to fit snugly into the depression such that the resulting upper surface of the combined pillow members is not greatly unlike the bottom surface of the first pillow member.

Thus, a completely new and unique therapeutic pillow is shown herein, developed for the growing child and the small framed adult.

These and other objects, features and advantages of the present invention will be apparent from the following description, appended claims and annexed drawings.

BRIEF DESCRIPTION OF THE DRAWINGS

The invention will be better understood and objects other than those set forth above will become apparent when consideration is given to the following detailed description thereof. Such description means reference to the annexed drawings wherein.

DETAILED DESCRIPTION OF THE PREFERRED EMBODIMENT

Figure 1:
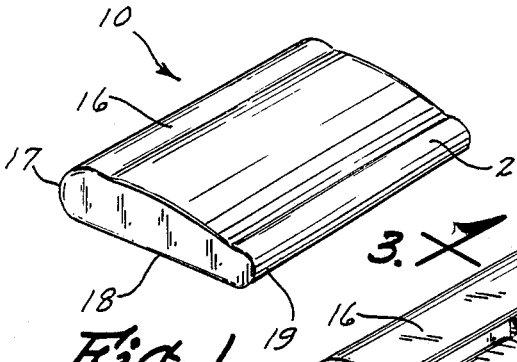
FIG. 1 is a perspective view of the therapeutic pillow of this invention.

The pillow of this invention capable of attaining the objects described hereinbefore is generally indicated by the numeral (10) in FIG. 1. Generally the therapeutic pillow (10) comprises a firm first pillow member (11), a less firm or softer second pillow member (12), the first and second pillow members (11) and (12) being bonded together to form the pillow (10) having an outer shape as best shown in FIGS. 1 and 3; with an outer ticking (13) covering the combined pillow members (11) and (12) to present the complete therapeutic pillow.

Figure 2:
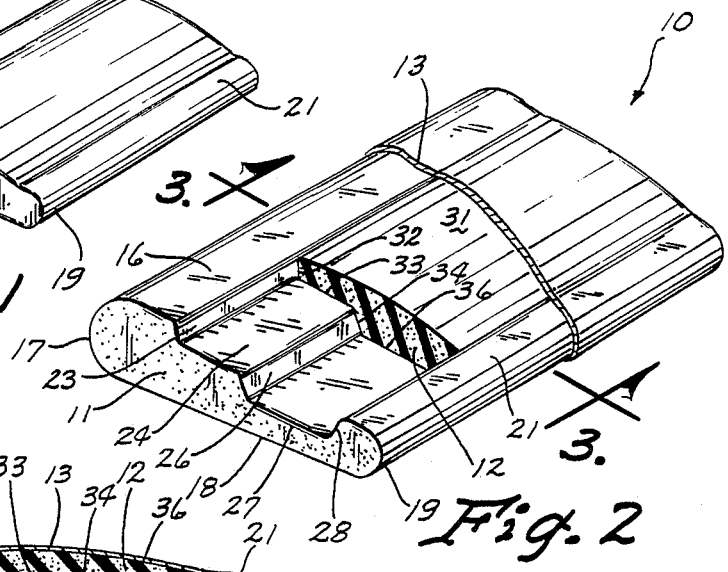
FIG. 2 is an enlarged view thereof, with a cover partially removed, a first pillow shown with one end thereof in side elevation, a second pillow member shown in cross section.
Figure 3:
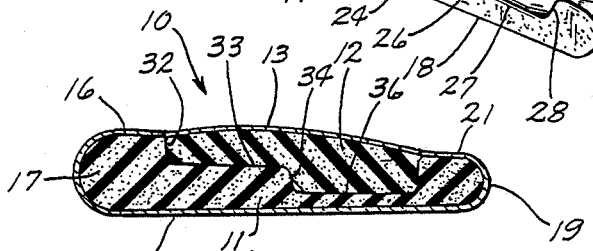
FIG. 3 is a cross sectional view taken along the line 3—3 in FIG. 2

More particularly, and referring to FIGS. 2 and 3, the first pillow member (11) is comprised, in cross section, with a wide side (16), a slightly rounded high edge (17), a relatively flat or planar bottom surface (18), a lower or narrow edge (19) as compared to edge (17), and a narrow side (21). Thee elements comprise exposed surfaces of the first pillow member (11). The remainder of the first pillow member (11) includes normally non-exposed surfaces such as a first shoulder (23) co -pending from the inner edge of the side (16), an upper ledge (24) extending inwardly from the bottom of the first shoulder (23), a second shoulder (26) which depends from the inner edge of the upper ledge (24), a lower ledge (27) extending inwardly above the second shoulder (26), and a third shoulder (28) which extends between the inner edge of the lower ledge (27) and the upper edge of the narrow side (21).

As can readily be seen from viewing the first pillow member (11) in side elevation in FIG. 2 or in cross section in FIG. 3, generally the first pillow member has upper and opposite sides (16) and (21), opposed edges (17) and (19) one of which is higher or more thick than the other, a planar surface (18) on the bottom, for example, of the first pillow member (11), and an irregular surface comprised of the elements (23), (24) and (26–28) extended between the sides (16) and (21). The first pillow member (11) is comprised of a polyurethane cellular foam plastic.

The second pillow member (12) as best shown in FIGS. 2 and 3, is comprised of one surface (31) adapted to form a relatively smooth surface with and between the opposite sides (16) and (21) of the first pillow member (11), and includes further another surface of an irregular nature which is adapted to mate with the normally non-exposed surfaces of the first pillow member (11). The irregular surface of the second pillow member (12) is comprised of an end (32), an upper wall (33), a second edge (34), a lower wall (36) and an opposite end (37). Referring to FIG. 3, it will be seen that the end (32) mates with the first shoulder (23) of the first pillow member (11), the upper wall (33) mates with the upper ledge (24), the second edge (34) mates with the second shoulder (26), the lower wall (36) mates with the lower ledge (27), and the opposite end (37) mates with the third shoulder (28) of the first pillow member (11). The first and second pillow members (11) and (12) are bonded together by any known means, and the second pillow member (12) is comprised of a polyester fiber.

Figure 4:
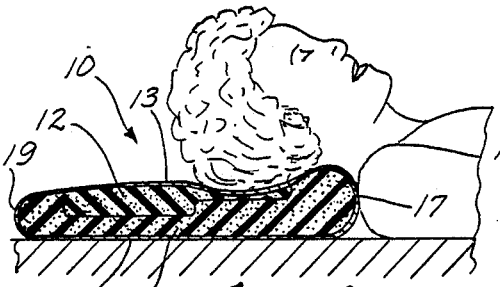
FIG. 4 a view of the pillow of this invention in cross section, showing its use in one position thereof by an older child.
Figure 5:
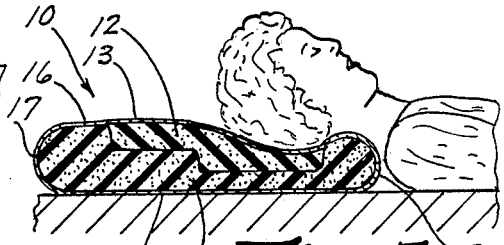
FIG. 5 is a view of the pillow of this invention in cross section, showing its use in another position thereof by a younger child.
Figure 6:
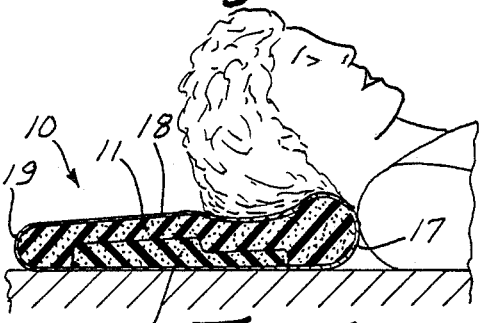
FIG. 6 is a view of the pillow of this invention in cross section, showing its use in another position thereof by an older child.

Referring particularly to FIGS. 4–11, the various therapeutic uses of this posture pillow (10) are shown. For example, FIG. 4 shows the pillow (10) with the neck of an older child resting on the higher edge (17), the head resting on the softer center of the second pillow member (12), and the shoulder of the older child engaging the higher edge (17). For a different therapeutic purpose, the pillow (10) may be reversed or flipped as is shown in FIG. 6 wherein the older child again has its neck and shoulder engaged with the higher or thicker edge (17), but here with the head resting on the more firm medium center of the first pillow member (11).

Figure 7:
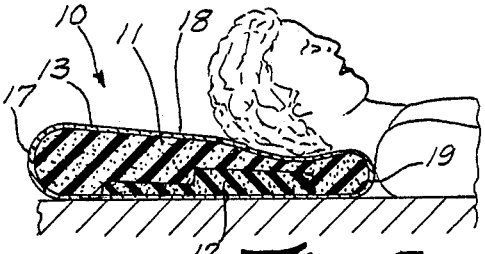
FIG. 7 a view of the pillow of this invention in cross section, showing its use in another position thereof by a younger child.
Figure 8:
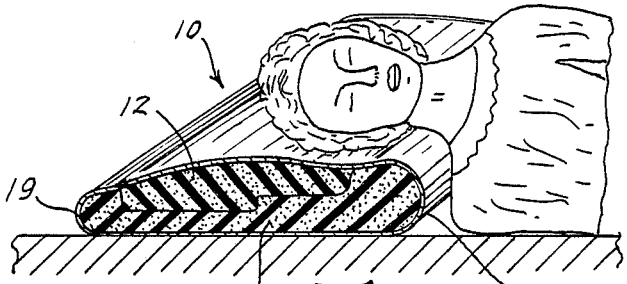
FIG. 8 is a view of the pillow of this invention in cross section, showing its use in one position thereof by an older child, the resting in a side position.

In FIG. 5, a younger child has its neck and shoulder engaging the more narrow edge (19) of the pillow (10), with the head resting on the softer center portion of the second pillow member (12). In FIG. 7, the pillow (10) has been reversed such that the head of the younger child rests on the more firm medium center of the first pillow member (11).

In FIGS. 8 and 10, again an older child or a small framed adult is utilizing the pillow (10), the neck and shoulder of the person engaging the higher edge (17) of the pillow, the head of the person in FIG. 8 engaging the softer center of the second pillow member (12), but with the pillow reversed in FIG. 10 the head rests against the more firm center of the first pillow member (11).

Figure 9:
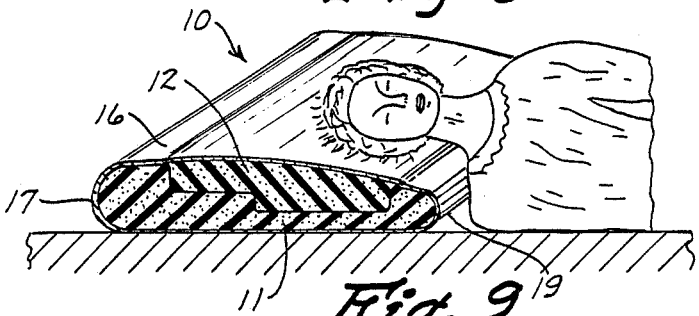
FIG. 9 a view of the pillow of this invention in cross section, showing its use in another position thereof by a younger child, the younger child resting in a side position.
Figure 10:
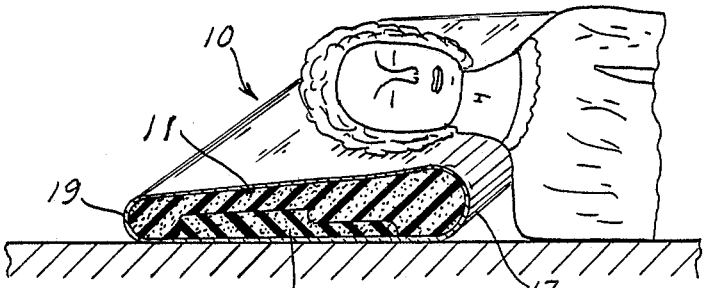
FIG. 10 is a view of the pillow of this invention in cross section, showing its use in one position thereof by an older child, the child resting in a side position.
Figure 11:
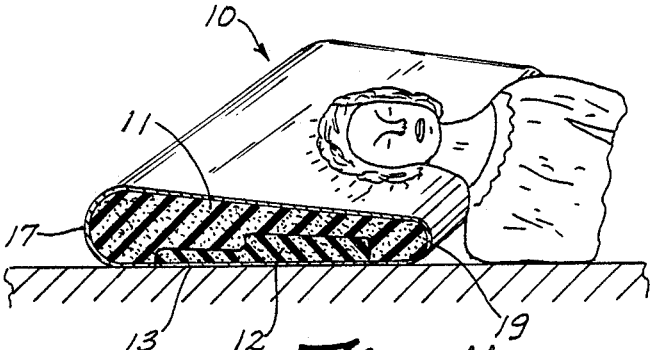
FIG. 11 is a view of the pillow of this invention in cross section, showing its use in another position thereof by a younger child, the younger child resting in a side position.

In FIGS. 9 and 11, the younger child again is shown in a side position, the neck and shoulder resting against the narrower edge (19), the head in FIG. 9 resting on the softer center of the second pillow member (12), but with the pillow reversed in FIG. 11 the head rests against the more firm medium center of the first pillow member (11).

It is seen, therefore, that an extremely unique posture pillow for therapeutic purposes is provided herein. Although the pillow has been designed primarily for children from ages four to twelve, adults having the same small frames as children could use the pillow as well. With respect to utilizing the pillow for children, if a condition is properly managed during the growth days of life it will eliminate problems later in life for that individual. Thus, the lower side (19) could be utilized by children between the ages of four and eight, with the higher side (17) being utilized by children ages nine through twelve. Furthermore, the more firm thicker edge (17) with the pillow being placed in the position of FIG. 3 thereby provides a softer center by means of the second pillow member(12) which provides a mild form of traction; whereas, by flipping the pillow upside down such that a more firm portion of the first pillow member (11) is on the upper side of the pillow, a lesser amount of traction will be provided. The pillow is therefore essentially four pillows in one depending upon what side of the pillow the individual sleeps.

The height of the pillow also has an effect on the way the position can treat a specific condition. For example, the higher side (17) can be used for the acute patient. This puts the head into flexion allowing for maximum joint swelling immediately after an injury occurs. When the patient has gone from the acute to the chronic stage, he or she can use the lower side (19) which puts the neck into extension—the recommended posture attitude for normal sleeping.

I claim:

1. A pillow for supporting the head and neck of a person lying in a supine or side position, comprising:

a first pillow member having upper opposite sides, opposed edges, a planar surface, and an irregular surface extended between said sides and having an upper wall and a lower wall generally parallel to said planar surface, the said sides extended partially over said planar surface; and a second pillow member having one irregular surface mated with said first member irregular surface such that said second member is nested between said opposite sides, and having a second surface forming a relatively smooth surface with the opposite sides of said first member, wherein said pillow members have differing consistencies to present different resistances, and wherein said first pillow member opposed edged have different thicknesses, said pillow being reversible whereby to provide a quartet of different support positions for the head and neck of the person using same;

and further wherein said pillow members form at least a pair of different resistances between the opposite sides, a first resistance comprised of a thin cross-section of general constant thickness of said second pillow member and a thick cross-section of general constant thickness of said first pillow member, and a second resistance comprised of a thick cross-section of general constant thickness of said second pillow member and a thin cross-section of general constant thickness of said first pillow member.

* * * * *